US006563481B1

(12) United States Patent
Watanabe et al.

(10) Patent No.: US 6,563,481 B1
(45) Date of Patent: May 13, 2003

(54) ACTIVE MATRIX LIQUID CRYSTAL DISPLAY DEVICE, METHOD OF MANUFACTURING THE SAME, AND METHOD OF DRIVING THE SAME

(75) Inventors: Makoto Watanabe, Tokyo (JP); Takahiko Watanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/501,685

(22) Filed: Feb. 10, 2000

(30) Foreign Application Priority Data

Feb. 10, 1999 (JP) ..... 11-032847

(51) Int. Cl.[7] ..... E09G 3/36

(52) U.S. Cl. ..... 345/87; 345/92; 345/95; 345/98; 345/99; 345/103; 345/208

(58) Field of Search ..... 345/87, 92, 95, 345/98, 99, 103, 208

(56) References Cited

U.S. PATENT DOCUMENTS

| | | | | |
|---|---|---|---|---|
| 4,340,909 A | * | 7/1982 | Yamada et al. | 257/215 |
| 4,818,981 A | * | 4/1989 | Oki et al. | 345/205 |
| 4,955,697 A | | 9/1990 | Tsukada | |
| 5,049,832 A | | 9/1991 | Cavers | |
| 5,093,637 A | | 3/1992 | Isota et al. | |
| 5,412,397 A | * | 5/1995 | Kanatani et al. | 345/100 |
| 5,420,536 A | | 5/1995 | Faulkner et al. | |
| 5,486,789 A | | 1/1996 | Palandech et al. | |
| 5,524,286 A | | 6/1996 | Chiesa et al. | |
| 5,694,145 A | * | 12/1997 | Kondo et al. | 345/100 |
| 5,945,866 A | * | 8/1999 | Fonash et al. | 327/427 |
| 6,204,895 B1 | * | 3/2001 | Nakamura et al. | 349/187 |
| 6,323,835 B1 | * | 11/2001 | Negishi et al. | 345/100 |

FOREIGN PATENT DOCUMENTS

| | | |
|---|---|---|
| EP | 0 797 294 | 9/1997 |
| JP | 2-42420 | 2/1990 |
| JP | 3-38689 | 2/1991 |
| JP | 4-269791 | 9/1992 |
| JP | 5-204331 | 8/1993 |
| JP | 5-333376 | 12/1993 |
| JP | 6-148680 | 5/1994 |
| JP | 10-73843 | 3/1998 |
| JP | 10-171412 | 6/1998 |
| WO | WO 98/04034 | 1/1998 |
| WO | WO 98/12800 | 3/1998 |

* cited by examiner

*Primary Examiner*—Amare Mengistu
*Assistant Examiner*—Vincent E. Kovalick
(74) *Attorney, Agent, or Firm*—Choate, Hall & Stewart

(57) ABSTRACT

An active matrix liquid crystal display device includes a pair of substrates that seal a liquid crystal, thin film transistors, display pixel electrodes, m/s (s and m are natural numbers that render m/s a natural number) drain bus lines, s×n gate bus lines, and a controller. The thin film transistors are arranged on one of said substrates to form a matrix of n rows×m columns. The display pixel electrodes are connected to source electrodes of said thin film transistors in one-to-one correspondence. The drain bus lines are connected to drain electrodes of the matrix-type thin film transistors in s-to-1 correspondence. The gate bus lines are connected to gate electrodes of the thin film transistors on each row in one-to-one correspondence. The controller selects n gate bus lines in each of s frames starting from an (s×t(t is an arbitrary positive integer)+1)th frame and ended with an (s×t+s)th frame to perform one-screen display with the s frames. A method of manufacturing this display device, and a method of driving the same are also disclosed.

8 Claims, 20 Drawing Sheets

| [Line] | [Name] | [Offset] | [Dim] | [Alter] | [Temperature] |
|---|---|---|---|---|---|
| ——— | GATE VOLTAGE :V.G | 0.0 | Volt | 0.0 | 27.0 |
| ---------- | PARITY BUS LINE VOLTAGE : V.P | 0.0 | Volt | 0.0 | 27.0 |
| —·—·— | GATE VOLTAGE INPUTTED TO PIXEL : V.GL2 | 0.0 | Volt | 0.0 | 27.0 |
| —·— | DRAIN VOLTAGE : V.D2 | 0.0 | Volt | 0.0 | 27.0 |
| —·—·— | PIXEL VOLTAGE :V.S | 0.0 | Volt | 0.0 | 27.0 |

SIZE OF GATE SELECTION TFT IS 4000/4
ON VOLTAGE OF GATE SELECTION TFT IS 30V
OFF VOLTAGE OF GATE SELECTION TFT IS -10V

L(= 4μm) : CHANNEL LENGTH OF GATE SELECTION TFT $V_{PG}^{ON}$(= 30V) : ON VOLTAGE OF GATE SELECTION TFT $V_{PG}^{OFF}$(= −10V) : OFF VOLTAGE OF GATE SELECTION TFT

AT HALF VALUE : $\Delta VD = 3V, V_{PG}^{ON} = 30V$ $\Delta VD$ : DRAIN VOLTAGE AMPLITUDE $V_{PG}^{ON}$ : ON VOLTAGE OF GATE SELECTION TFT

ACTIVE MATRIX LIQUID CRYSTAL DISPLAY DEVICE, METHOD OF MANUFACTURING THE SAME, AND METHOD OF DRIVING THE SAME

BACKGROUND OF THE INVENTION

1. Field of the Invention

The present invention relates to an active matrix liquid crystal display device, a method of manufacturing the same, and a method of driving the same suitable for a liquid crystal display device of an active matrix type.

2. Description of the Prior Art

A liquid crystal display panel for a conventionally general active matrix liquid crystal display device is expressed by an equivalent circuit shown in FIG. 1. More specifically, gate bus lines G1 to G4 and drain bus lines D1 to D4 are arranged to perpendicularly intersect each other, and a transistor 1 and a display pixel 2 are connected to each of their intersections. Each display pixel 2 is connected to a common electrode 3.

This active matrix liquid crystal display device is driven by drive signals shown in FIG. 3 in order to display a display pixel array dij (i, j=1, 2, 3, . . . ) as shown in FIG. 2. More specifically, one of the gate bus lines G1 to G4 is set at high level to turn on the corresponding transistors, and data on the drain bus lines D1 to D4 are written in the corresponding display pixels. This operation is sequentially performed for the gate bus lines G1 to G4, so that the liquid crystal display panel performs display with its display pixels.

In this manner, in the conventionally general active matrix liquid crystal display device, one drain bus line driving driver is required for each intersection of the gate bus lines G1 to G4 and drain bus lines D1 to D4 arranged to form a matrix.

Since the drain bus line driving driver covers a wide frequency range such as that of an image signal and operates at a high data rate, it is expensive. When the number of display pixels increases, a large number of expensive drain bus line driving drivers must be used, and the resultant liquid crystal display device becomes expensive.

In order to eliminate these drawbacks, for example, Japanese Unexamined Patent Publication Nos. 3-38689, 6-148680, and 4-269791 disclose the following techniques.

The outline of the technique of Japanese Unexamined Patent Publication No. 3-38689 will be described with reference to FIGS. 4 to 6. FIG. 4 is an equivalent circuit diagram of a liquid crystal panel, FIG. 5 is a view showing the display data arrangement, and FIG. 6 is a timing chart for displaying the data arrangement of FIG. 5.

Referring to FIG. 4, two columns of display pixels are connected to one drain bus line D1 or D2, and gate bus lines G1 to G8 are connected to the transistors on one drain bus line D1 or D2.

In this case, as shown in FIG. 6, the gate potentials of the gate bus lines G1, G3, G5, and G7 are set at high level and subsequently the gate potentials of the gate bus lines G2, G4, G6, and G8 are set at high level, so that the transistors aligned on the bus line are turned on. Data on the drain bus line D1 or D2 is written in the display pixel at this ON timing.

As shown in FIG. 5, on the drain bus line D1, data are written in d11, d21, d31, and d41 on the first display pixel column, and subsequently in d12, d22, d32, and d42 on the second display pixel column. Data write is performed on the other drain bus line D2 in the same manner.

According to this method, one drain bus line D1 or D2 can drive two display pixel columns. As a result, the number of drivers for the drain bus lines D1 and D2 can be halved, so that the product cost can be reduced.

The technique shown in Japanese Unexamined Patent Publication No. 6-148680 also aims at reduction of the product cost by increasing the number of gate bus lines while decreasing the number of expensive drain bus lines.

The outline of the technique shown in Japanese Unexamined Patent Publication No. 4-269791 will be described with reference to the equivalent circuit diagram of the liquid crystal panel shown in FIG. 7.

Display signal electrodes that form a liquid crystal signal-side drive circuits have transfer gates QT, driving transfer gates Q, and capacitors CL serving as line memories in units of columns. Each of display signal terminals VD1 to VD40 is connected to either the source electrodes or drain bus lines of the plurality of transfer gates QT. Each of selection signals Φ1 to Φ48 is connected to the gate electrodes of the plurality of transfer gates QT.

Note that an arbitrary one of gate voltage terminals VG1 to VG180 serving as scanning-side extending electrodes is selected, and one gate bus line is selected.

While one gate bus line is selected, selection signals are supplied to the selection signal terminals Φ1 to Φ48 sequentially. While one selection signal terminal Φi(i=1, 2, 3, . . . ) is selected, display signals corresponding to 40 columns are supplied to the display signal terminals VD1 to VD40, to write data in capacitors Ci (i=1, 2, 3, . . . ) serving as memory cells.

Furthermore, the liquid crystal cells LC are driven through the driving transfer gates Q. When this operation is performed 48 times, display data is written in all the liquid crystal cells LC forming a 1-line display portion.

According to the technique shown in Japanese Unexamined Patent Publication No. 4-269791, cost reduction is realized by decreasing the number of drivers on the drain bus lines without increasing the number of drivers on the gate bus lines.

In Japanese Unexamined Patent Publication Nos. 3-38689 and 6-148680 described above, although the number of drain bus drivers is decreased, the number of gate drivers is increased. Hence, further improvements are needed to achieve cost reduction of the liquid crystal display device.

According to Japanese Unexamined Patent Publication No. 4-269791, the ON resistances of transfer gates Q and QT and the capacitances of capacitors CL serving as memory cells in one liquid crystal panel vary due to the manufacturing process. Then, variations occur in the image signal voltage, leading to non-uniform brightness. Times held by the capacitors CL connected to the selection signal terminals and serving as the memory cells differ, possibly causing non-uniform brightness.

SUMMARY OF THE INVENTION

The present invention has been made in consideration of the above situation of the prior art, and has as its object to provide an active matrix liquid crystal display device which can improve the brightness uniformity without causing an increase in cost when manufacturing the device, a method of manufacturing the same, and a method of driving the same.

In order to achieve the above object, according to the first main aspect of the present invention, there is provided an active matrix liquid crystal display device comprising: a pair of substrates that seal a liquid crystal; thin film transistors arranged on one of the substrates to form a matrix of n rows×m columns; display pixel electrodes connected to source electrodes of the thin film transistors in one-to-one correspondence; m/s (s and m are natural numbers that render m/s a natural number) drain bus lines connected to drain electrodes of the matrix-type thin film transistors in s-to-1 correspondence; s×n gate bus lines connected to gate electrodes of the thin film transistors on each row in one-to-one correspondence; and a controller for selecting n gate bus lines in each of s frames starting from an (s×t(t is an arbitrary positive integer)+1)th frame and ended with an (s×t+s)th frame, to perform one-screen display with the s frames.

According to the first main aspect described above, gate selection TFTs having drain electrodes, source electrodes, and gate electrodes can be provided, the drain electrodes in units of gate bus lines being connected to gate terminals, the source electrodes being connected to the gate bus lines, and the gate electrodes being connected to gate switch lines that are set at an ON voltage in one frame every s frames.

The gate selection TFTs can be formed simultaneously with the thin film transistors connected to the display pixel electrodes in the same process.

A semiconductor film which forms the gate selection TFTs can be made of amorphous silicon, and can have a ratio of channel length to channel width of not less than 3000/4.

A gate ON voltage for the gate selection TFTs can be not less than 30 V, and a gate OFF voltage therefor can be not more than −10 V.

A semiconductor film which forms the gate selection TFTs can be made of polysilicon.

The gate electrodes of the gate selection TFTs can be switched within a blanking period.

One frame can be drawn with a time of 1/(50×n) to 1/(75×n) sec.

In order to achieve the above object, according to the second main aspect of the present invention, there is provided a method of manufacturing an active matrix liquid crystal display device, comprising: the first step of forming thin film transistors arranged to form a matrix of n rows×m columns on one of a pair of substrates that seal a liquid crystal; the second step of forming display pixel electrodes connected to source electrodes of the thin film transistors in one-to-one correspondence; the third step of forming m/s (s and m are natural numbers that render m/s a natural number) drain bus lines connected to drain electrodes of the matrix-type thin film transistors in s-to-1 correspondence; and the fourth step of forming s×n gate bus lines connected to gate electrodes of the thin film transistors on each row in one-to-one correspondence.

In the second main aspect described above, the fourth step can comprise the fifth step of connecting gate terminals to the drain electrodes in units of gate bus lines, the sixth step of connecting the gate bus lines to the source electrodes; and the seventh step of connecting gate switch lines to the gate electrodes, the gate switch lines being set at an ON voltage in one frame every s frames.

The fifth to seventh steps can be performed simultaneously with formation of the thin film transistors connected to the display pixel electrodes in the same process.

The fifth to seventh steps can include the step of forming a semiconductor film from amorphous silicon to have a ratio of channel length to channel width of not less than 3000/4.

The fifth to seventh steps can include the step of forming a semiconductor film from polysilicon.

In order to achieve the above object, according to the third main aspect of the present invention, there is provided a method of driving an active matrix liquid crystal display device, comprising driving the display device by setting a gate ON voltage for gate selection TFTs to not less than 30 V, and setting a gate OFF voltage therefor to not more than −10 V.

In the third main aspect described above, driving can be performed such that the gate electrodes of the gate selection TFTs are switched within a blanking period.

Driving can be performed such that one frame is drawn with a time of 1/(50×n) to 1/(75×n) sec.

As described above, with the active matrix liquid crystal display device, a method of manufacturing the same, and a method of driving the same according to the present invention, the thin film transistors are arranged on one of the pair of substrates that seal the liquid crystal to form a matrix of n rows×m columns. Display pixel electrodes are connected to source electrodes of the thin film transistors in one-to-one correspondence. M/s (s and m are natural numbers that render m/s a natural number) drain bus lines are connected to drain electrodes of the matrix-type thin film transistors in s-to-1 correspondence. S×n gate bus lines are connected to gate electrodes of the thin film transistors on each row in one-to-one correspondence. A controller selects n gate bus lines in each of s frames starting from an (s×t(t is an arbitrary positive integer)+1)th frame and ended with an (s×t+s)th frame. One-screen display is performed with the s frames. Therefore, the brightness uniformity can be improved without increasing the cost of the device.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Several preferred embodiments of the present invention will be described with reference to the accompanying drawings.

First Embodiment

Figure 1:
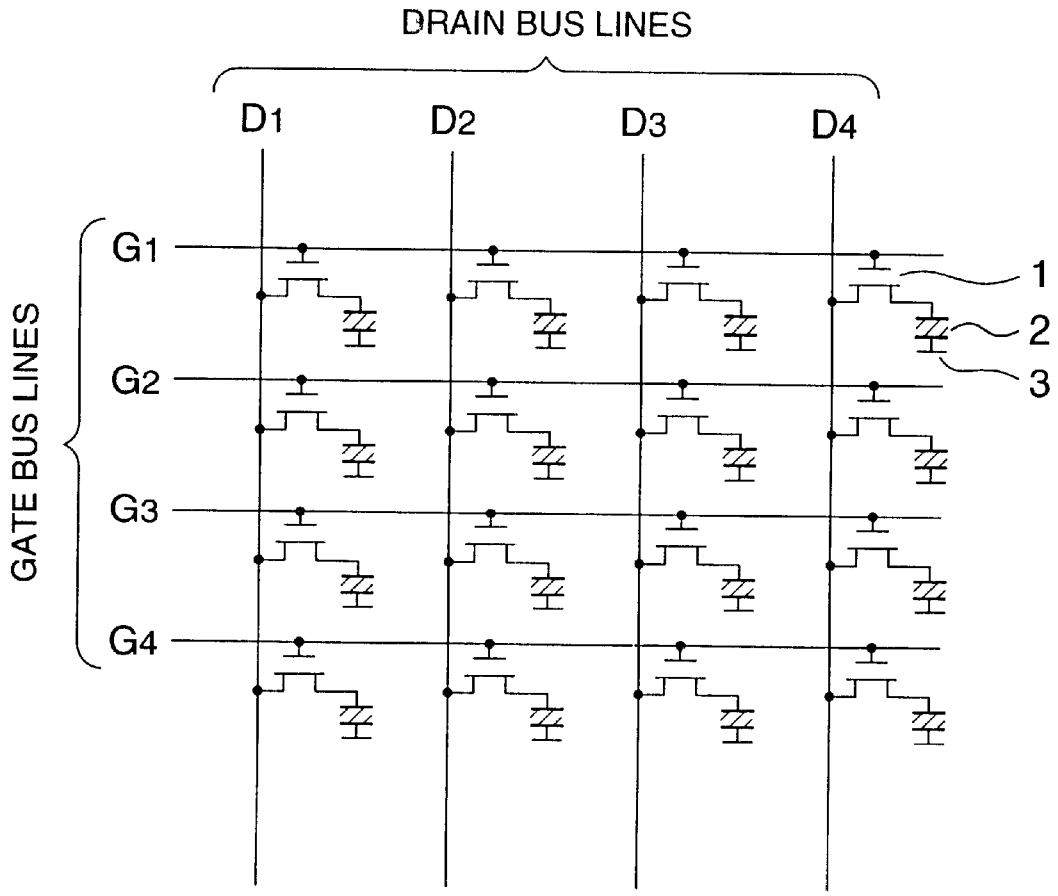
FIG. 1 PRIOR ART
FIG. 1 is an equivalent circuit diagram showing an example of a conventional active matrix liquid crystal display device.
Figure 2:
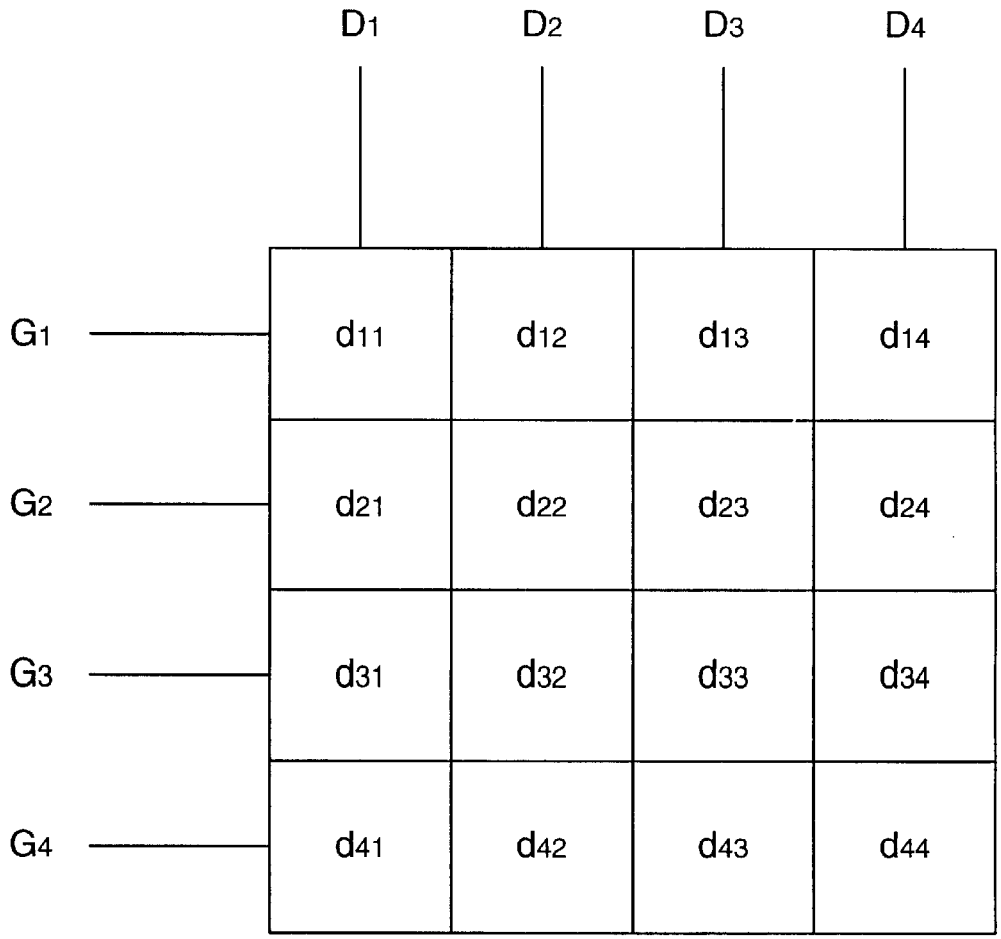
FIG. 2 PRIOR ART
FIG. 2 is a circuit diagram showing how to drive the active matrix liquid crystal display device shown in FIG. 1.
Figure 3:
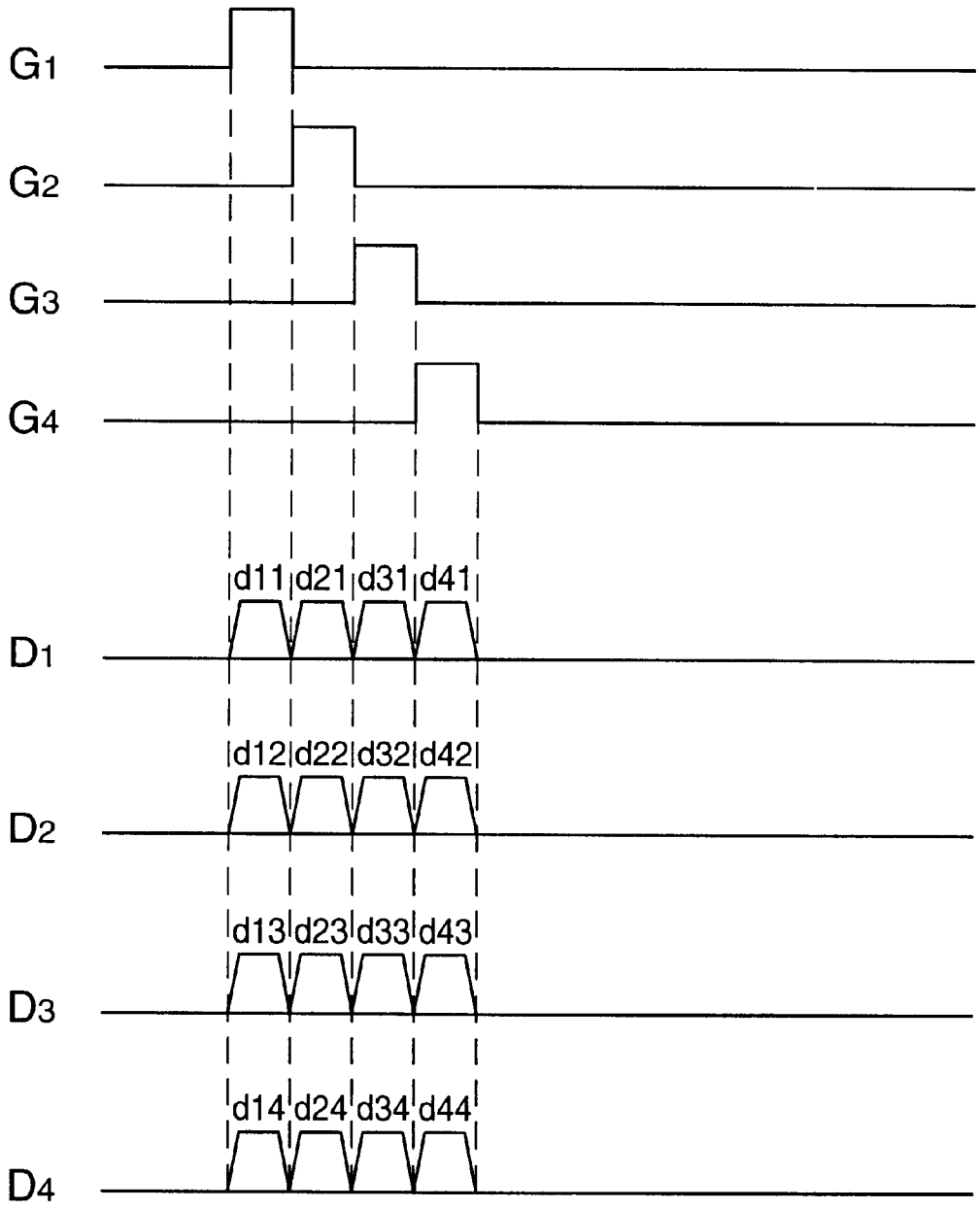
FIG. 3 PRIOR ART
FIG. 3 is a timing chart for explaining the operation of the active matrix liquid crystal display device shown in FIG. 1.
Figure 4:
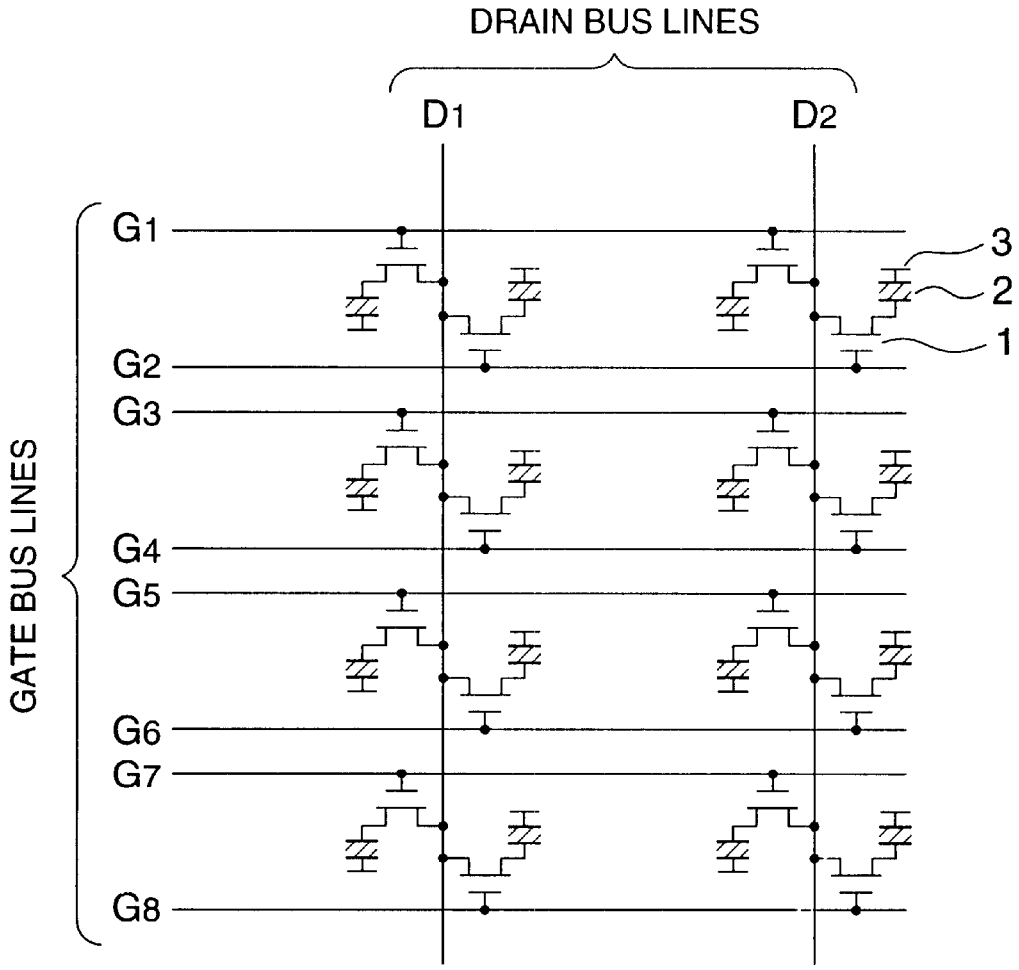
FIG. 4 PRIOR ART
FIG. 4 is an equivalent circuit diagram showing another example of the conventional active matrix liquid crystal display device.
Figure 5:
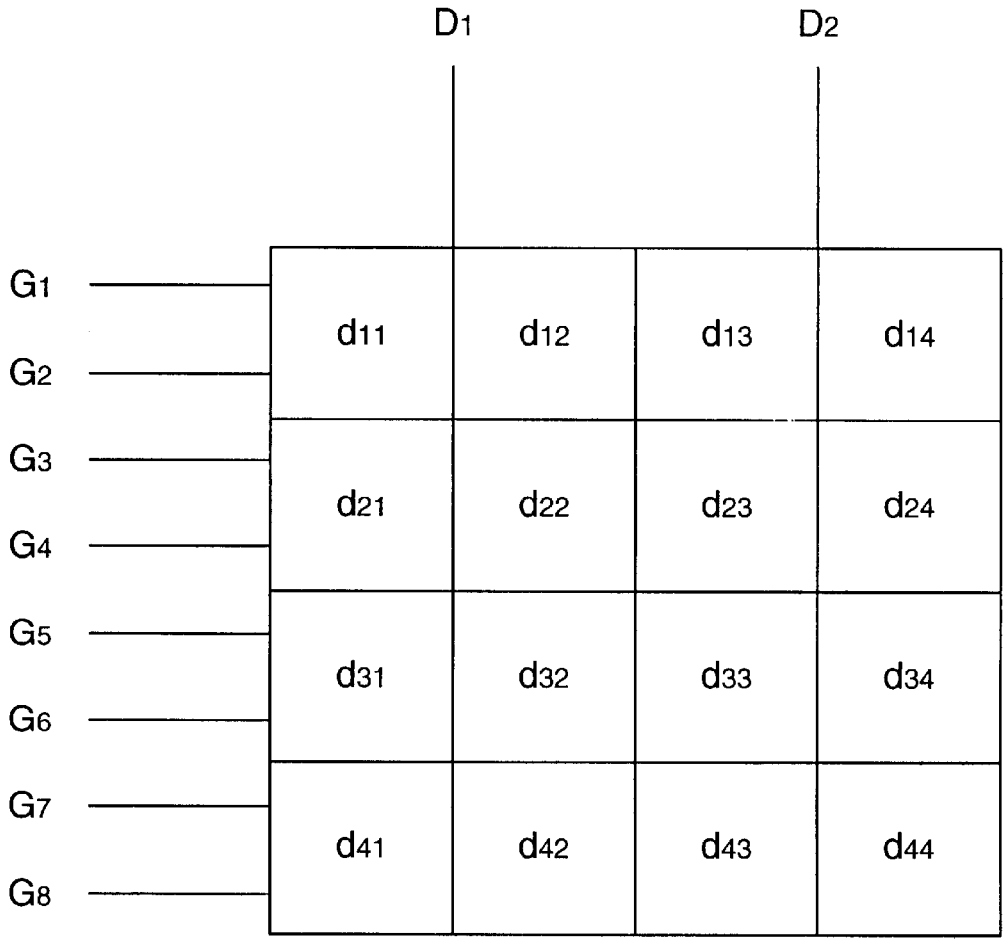
FIG. 5 PRIOR ART
FIG. 5 is a circuit diagram showing the display data arrangement of the active matrix liquid crystal display device shown in FIG. 4.
Figure 6:
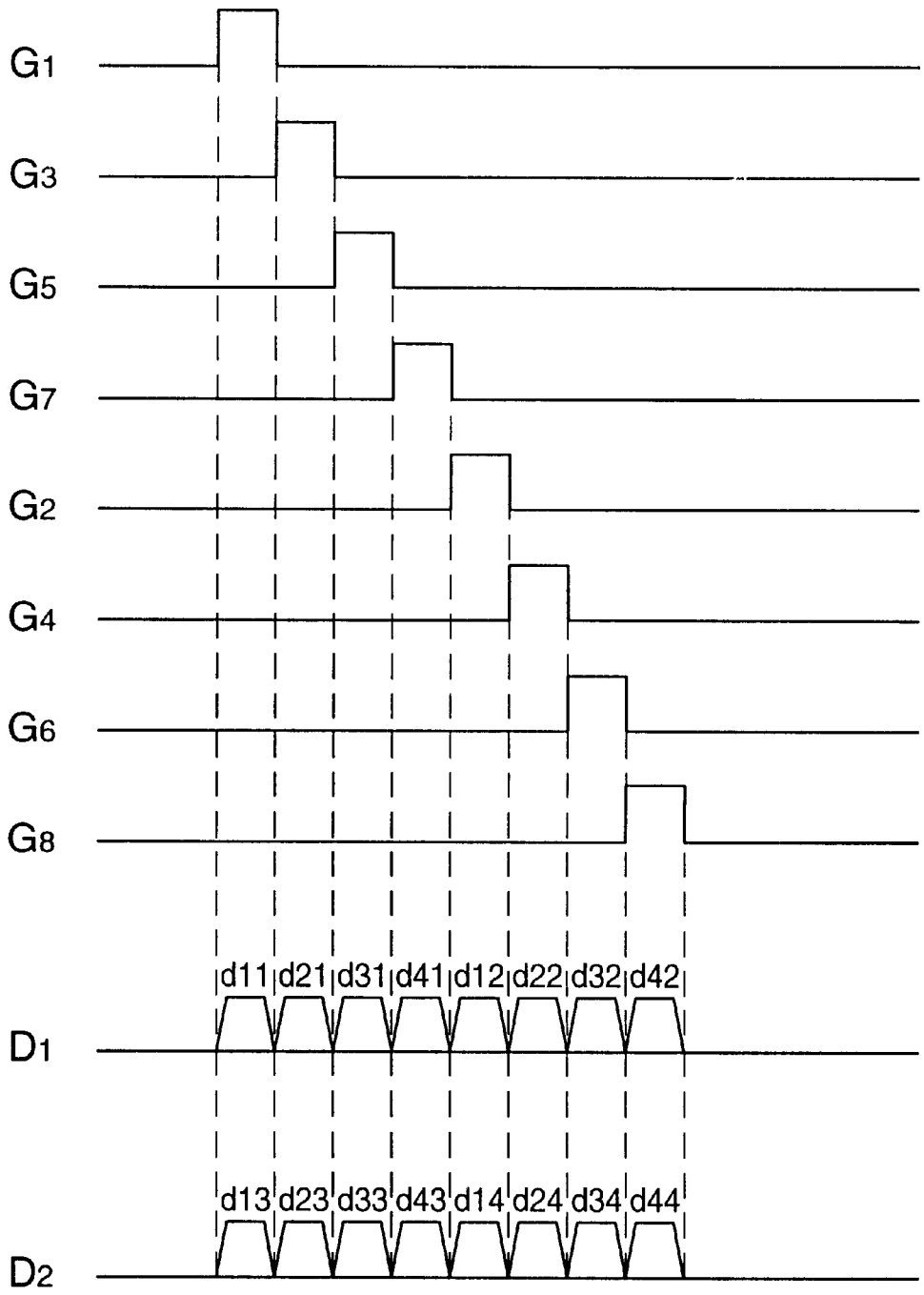
FIG. 6 PRIOR ART
FIG. 6 is a timing chart for displaying the display data arrangement shown in FIG. 5.
Figure 7:
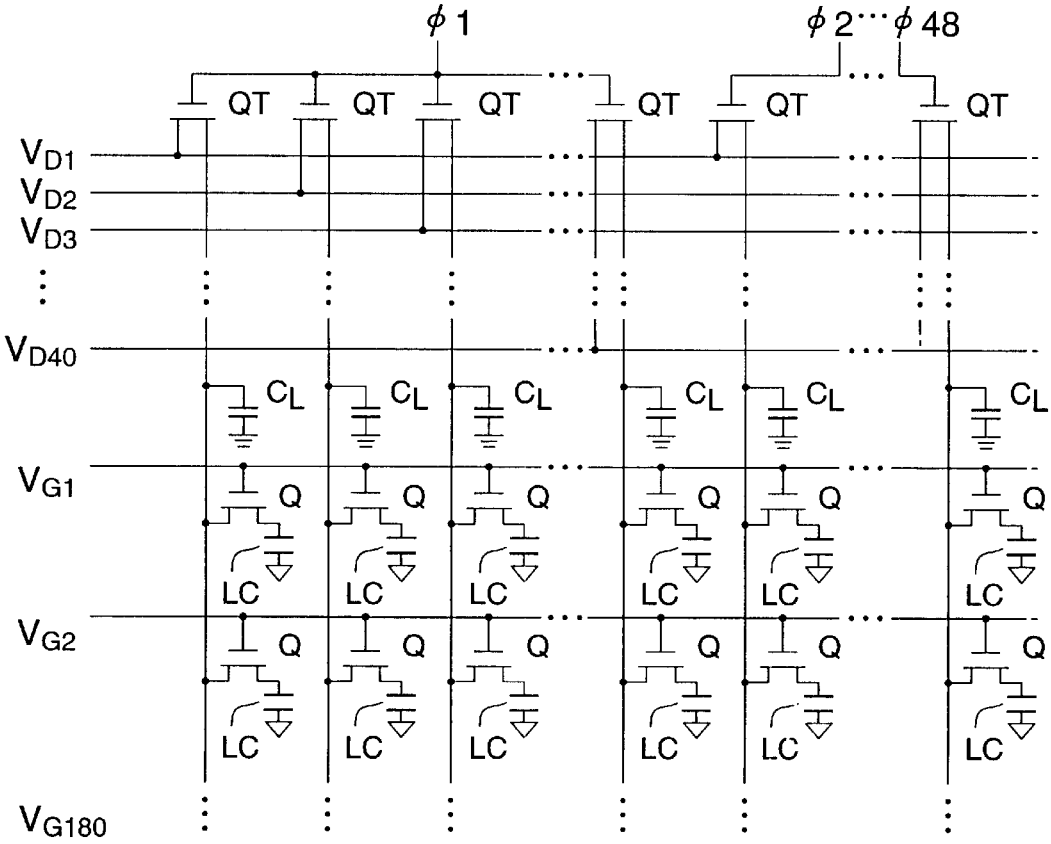
FIG. 7 PRIOR ART
FIG. 7 is an equivalent circuit diagram showing still another example of the conventional active matrix liquid crystal display device.
Figure 8:
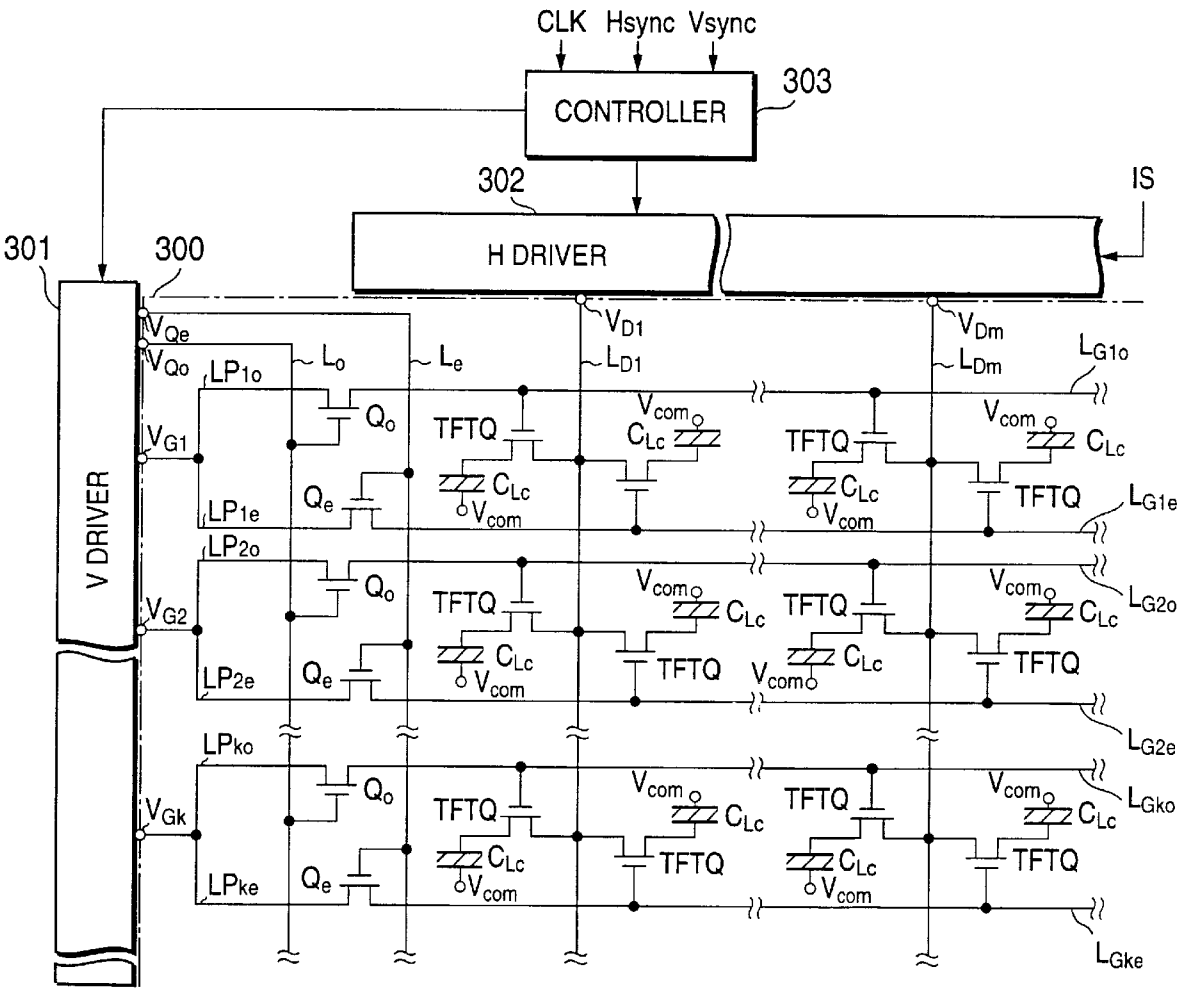
FIG. 8 is an equivalent circuit diagram sowing an active matrix liquid crystal display device according to the first embodiment of the present invention.
Figure 9:
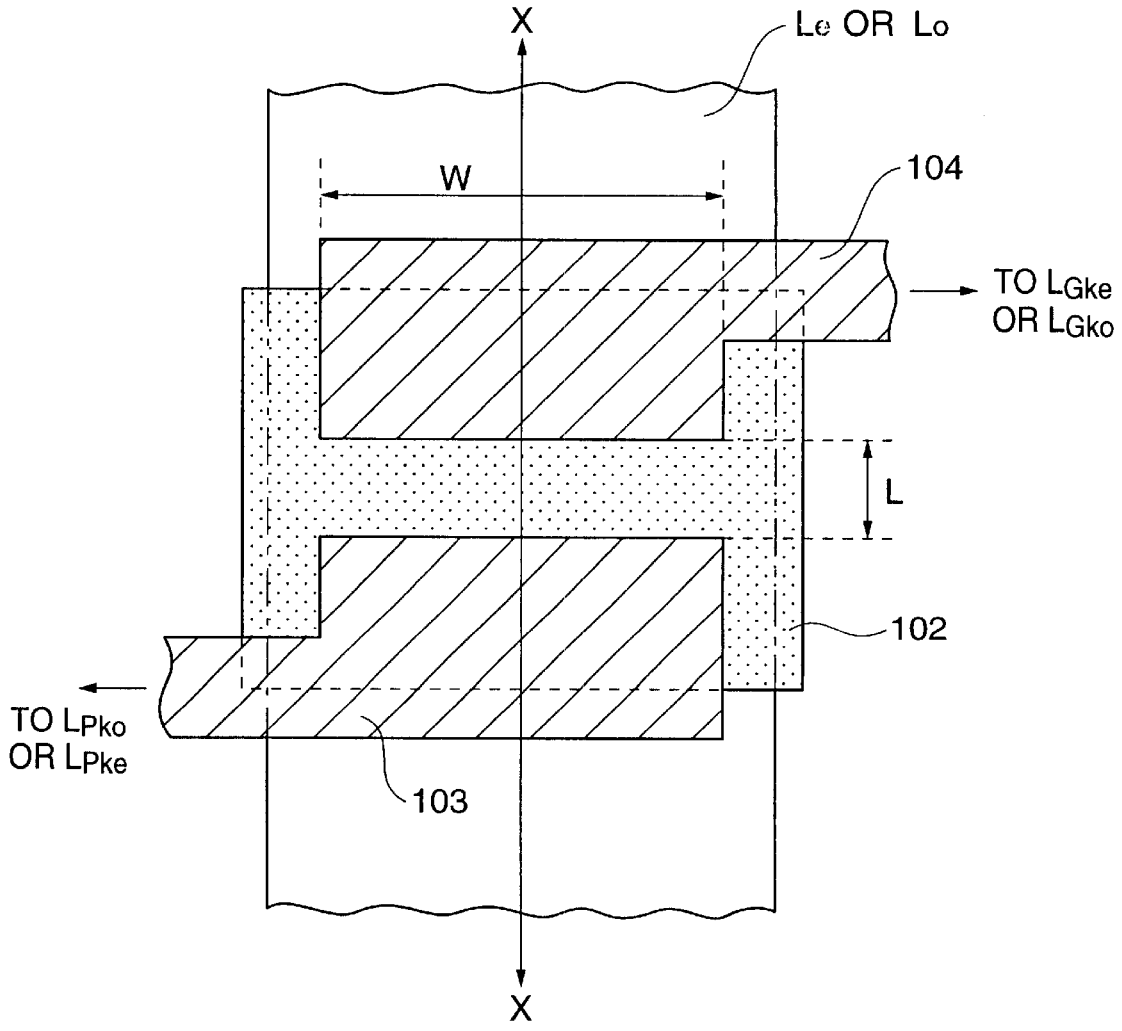
FIG. 9 is a plan view showing the gate selection terminal of a gate selection TFT shown in FIG. 8.
Figure 10:
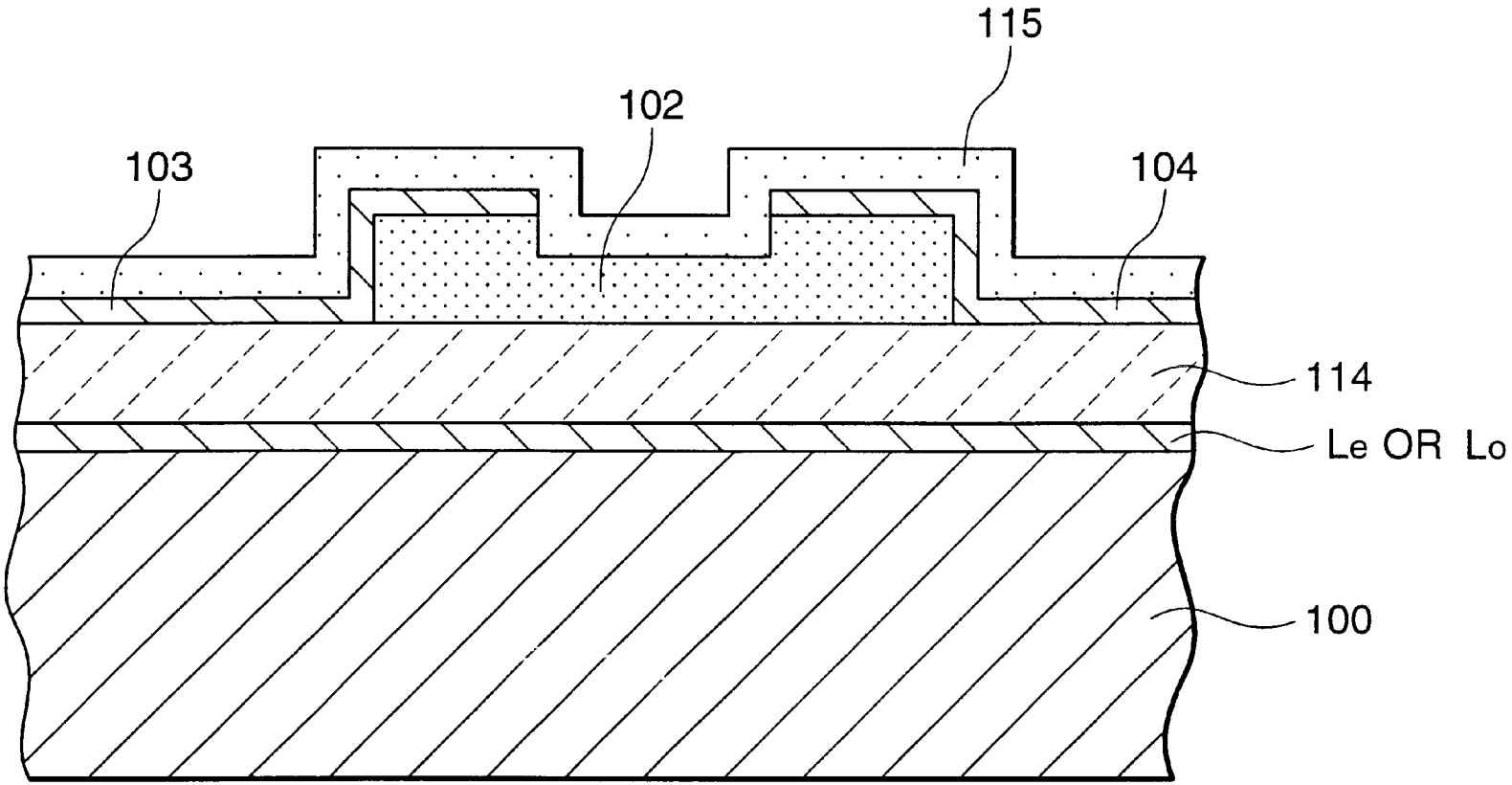
FIG. 10 is a sectional view taken along the line X—X in FIG. 9.

FIG. 8 is an equivalent circuit diagram sowing an active matrix liquid crystal display device according to the first embodiment of the present invention, FIG. 9 is a plan view showing the gate selection terminal of a gate selection TFT shown in FIG. 8, FIG. 10 is a sectional view taken along the line X—X in FIG. 9, and FIGS. 11 to 17 are views for explaining the operation of the active matrix liquid crystal display device shown in FIG. 8.

Referring to FIG. 8, an active matrix liquid crystal display device (to be merely referred to as a display device hereinafter) has a liquid crystal display panel 300, V driver 301, H driver 302, and controller 303.

Gate selection terminals VQo and VQe and gate voltage terminals VG1, VG2, . . . , and VGk of the liquid crystal display panel 300 are connected to the V driver 301 for generating a gate voltage waveform.

Drain voltage terminals VD1 to VDm are connected to the H driver 302 for generating a signal voltage waveform. An external image signal IS is input to the H driver 302.

The controller 303 for obtaining the timing of each voltage waveform is connected to the V driver 301 and H driver 302. A clock CLK generated by an oscillator (not shown) in the display device, and a horizontal sync signal Hsync and a vertical sync signal Vsync which are supplied from the outside of the display device are input to the controller 303.

Reference symbols Qo and Qe in the liquid crystal display panel 300 denote gate selection TFTs.

Two parity bus lines LPko and LPke (including LP10 to LP20) extend from each of the gate voltage terminals VG1 to VGk. Drain bus lines LD1 to LDm extend from the drain voltage terminals VD1 to VDm.

The parity bus lines LPko and LPke are connected to the drain electrodes of the transistors Qo and Qe serving as the gate selection TFTs. Gate bus lines LGko and LGke (including LG10 to LG20) extend from the source electrodes of the transistors Qo and Qe serving as the gate selection TFTs. A transistor Q serving as a display pixel driving transistor TFT is connected to each intersection of the drain bus lines LD1 to LDm and gate bus lines LGko and LGke. The transistor Q serving as the transistor TFT is connected to a display pixel CLC.

Gate selection switch lines Lo and Le respectively extend from the gate selection terminals VQo and VQe.

The potential of the display pixel CLC, on the side not connected to the transistor Q, which serves as the transistor TFT for driving the display pixel CLC, is maintained at a common electrode potential Vcom.

FIGS. 9 and 10 show the transistors Qo and Qe serving as the gate selection TFTs in detail.

In FIG. 9, reference symbol L denotes a channel length; and W, a channel width. Each of the transistors Qo and Qe serving as the gate selection TFTs has a size of W/L. Reference numeral 102 denotes an amorphous silicon film; 103, a drain electrode; and 104, a source electrode.

The transistors Qo and Qe serving as the gate selection TFTs are manufactured as shown in FIG. 10 which is a sectional view taken along the line X—X in FIG. 9. More specifically, a metal represented by Cr forms a film on a glass substrate 100, and the gate selection switch line Le or Lo is patterned by photolithography.

A gate insulating film 114 and the amorphous silicon film 102 are sequentially formed, and the drain electrode 103 and source electrode 104 are formed on them. After that, a passivation film 115 is formed to complete the transistor Qo or Qe serving as the gate selection TFT.

As shown in FIG. 9, the drain electrode 103 is connected to the parity bus line LPko or LPke. The source electrode 104 is connected to the gate bus line LGko or LGke.

The transistors Qo and Qe serving as the gate selection TFTs are formed simultaneously with the transistor Q serving as the display pixel driving transistors TFT, so an increase in number of steps can be avoided. The drain electrode 103 and source electrode 104 described above can be made of a metal other than Cr, or can be transparent electrodes.

Amorphous silicon which forms the amorphous silicon film 102 may be polysilicon. Although the transistors Qo and Qe serving as the gate selection TFTs form an inverted staggered structure, they can form a staggered structure.

In the equivalent circuit diagram shown in FIG. 8, the upper gate bus lines LGko connected to the gate voltage terminals VG1 to VGk are odd-numbered write lines, and the lower gate bus lines LGke connected thereto are even-numbered write lines. Even if the upper gate bus lines LGko are set as even-numbered write lines and the lower gate bus lines LGke are set as odd-numbered write lines, an equivalent effect can be obtained.

The operation of the active matrix liquid crystal display device having the above arrangement will be described with reference to FIGS. 11 to 17.

Figure 11:
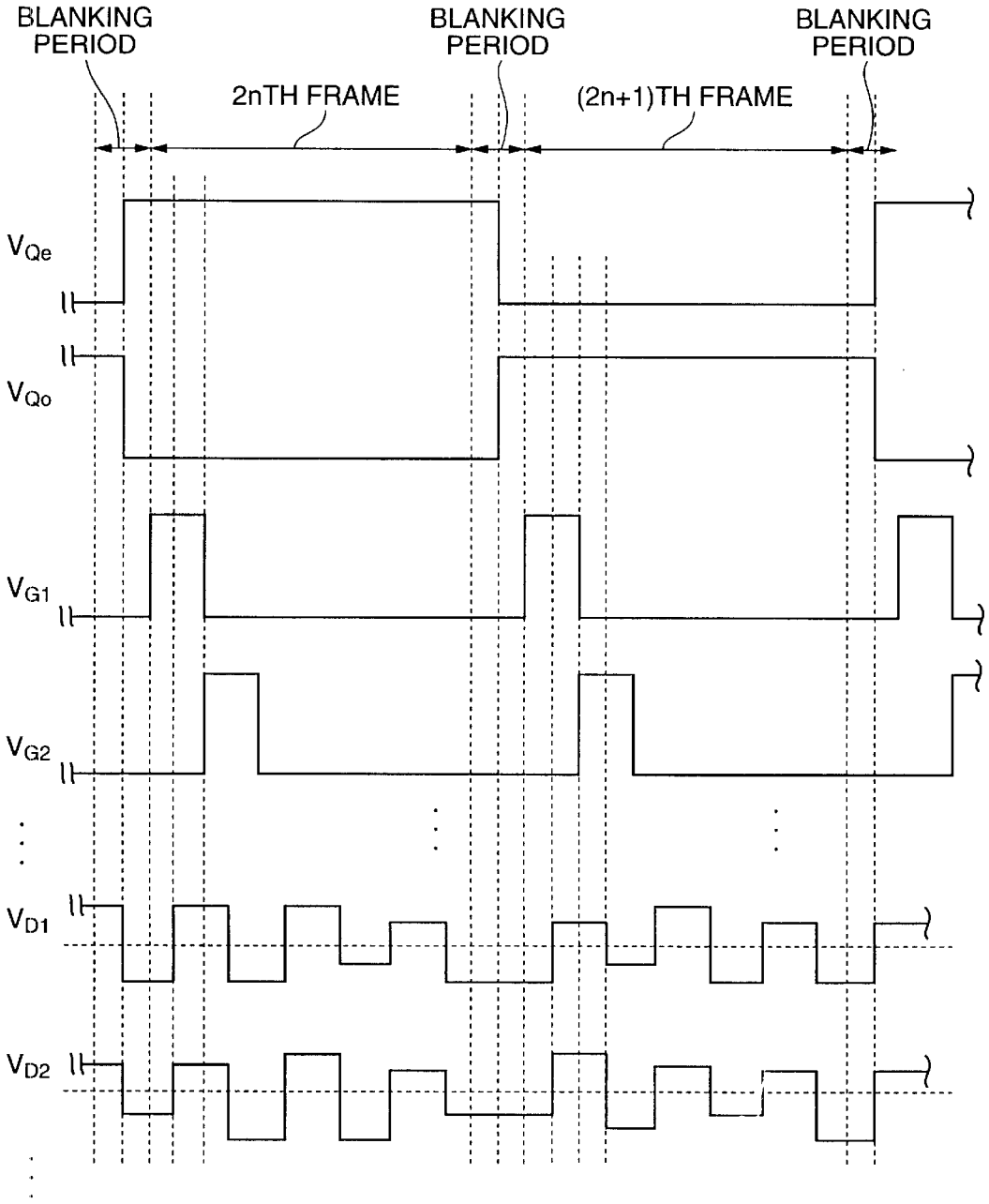
FIG. 11 is a timing chart for explaining the operation of the active matrix liquid crystal display device shown in FIG. 8.
Figure 12A:
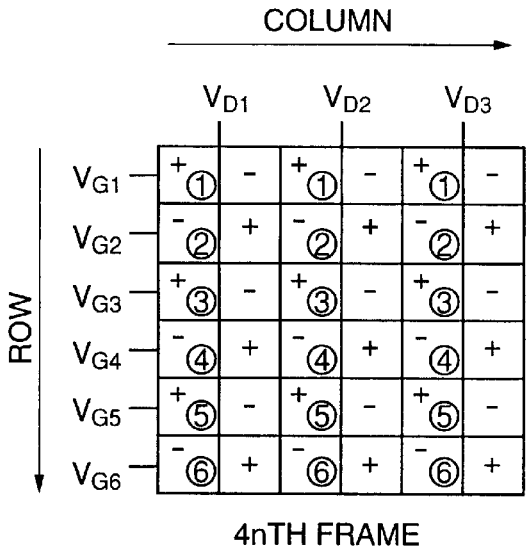
FIGS. 12A to 12D are views for explaining the operation of the active matrix liquid crystal display device shown in FIG. 8.
Figure 12B:
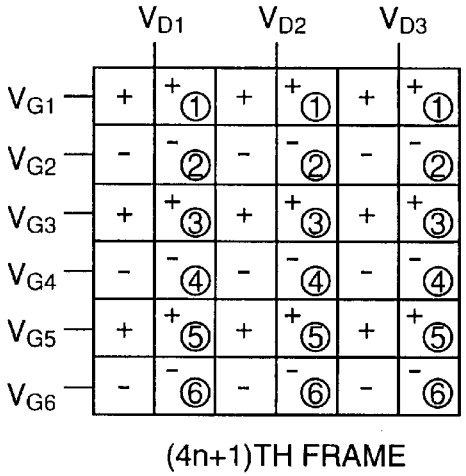
Figure 12C:
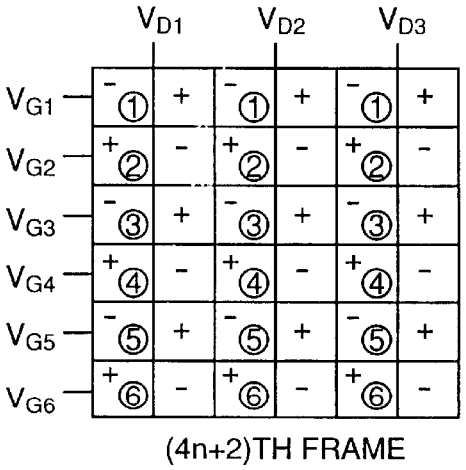
Figure 12D:
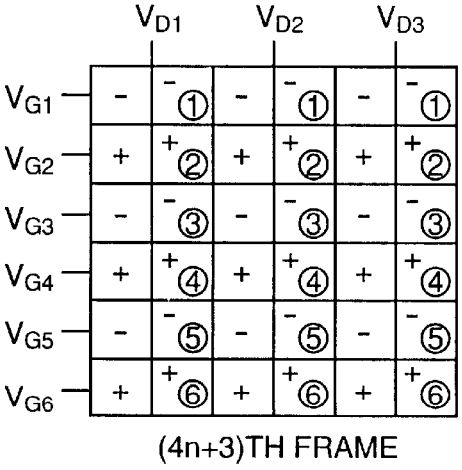

First, a description will be made with reference to FIG. 11 showing the timing chart and FIGS. 12A to 12D showing the voltage polarity and the voltage write order with which the voltage is written in the display pixels. In FIGS. 12A to 12D, circled numerals indicate the pixel write order in certain frames.

Referring to FIG. 11, the gate selection terminal VQo for selecting gates on odd-numbered rows are set at high potential in odd-numbered frames, and at low potential in even-numbered frames. The gate selection terminal VQe for selecting gates on even-numbered rows are set at high potential in even-numbered frames, and at low potential in odd-numbered frames.

Signals on the gate bus lines LGko and LGke and the signals VG1 and VG2 on the drain bus lines LD1 to LDm are identical to those of the prior art technique. Among the frames, a time called a blanking period exists, where the gate bus lines LGko and LGke on a certain row are also set at low potential.

When the liquid crystal display panel is actuated, the voltage is written in each pixel in the order and with the polarity shown in FIGS. 12A to 12D. For the sake of easy understanding, a case wherein the pixel electrodes form a 6×6 matrix will be described as an example.

In each odd-numbered frame, the gate bus lines LGko and LGke on the odd-numbered rows are sequentially selected, and the voltage is written in the display pixels on the odd-numbered columns. The voltage written in the preceding frame is held on the even-numbered columns. In the even-numbered frames, the gate bus lines LGko and LGke on the even-numbered rows are sequentially selected, and the voltage is written in the display pixels on the odd-numbered columns. The voltage written in the preceding frame is held on the odd-numbered columns.

Figure 13A:
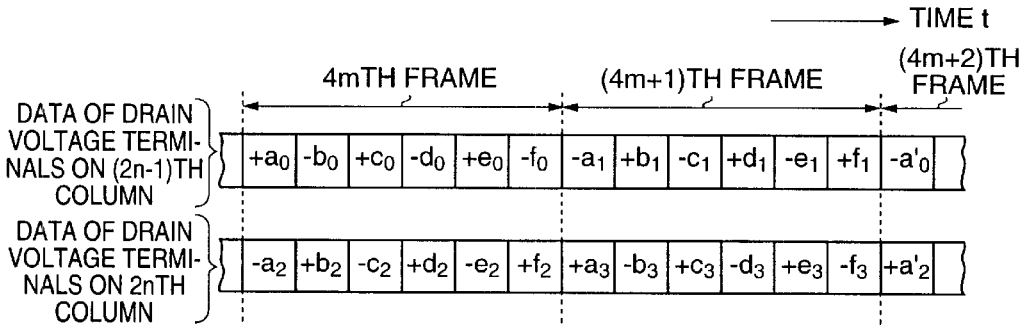
FIG. 13A is a view for explaining the operation of the conventional display device.
Figure 13B:
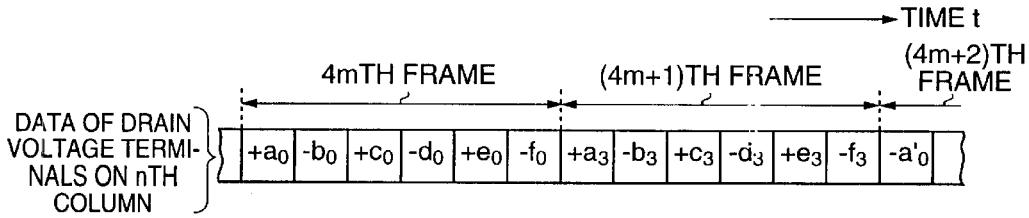
FIGS. 13B and 13C are views for explaining the operation of the active matrix liquid crystal display device shown in FIG. 8.

FIG. 13B shows the data sequence of an input signal to the drain voltage terminal at this time. FIG. 13A shows the data sequence of the prior art technique. In the first embodiment, data corresponding to one frame in the prior art technique is dealt with as a unit. In the odd-numbered frames, data on the odd-numbered columns are input to the drain bus lines LD1 to LDm, and in the even-numbered frames, data on the even-numbered columns are input to the drain bus lines LD1 to LDm.

This data selection is realized by receiving an image signal, serving as the serial data to be input to the H driver 302, at a timing having a period twice that of the prior art technique. A double-period timing signal is generated by a logic circuit in the controller 303.

Figure 13C:
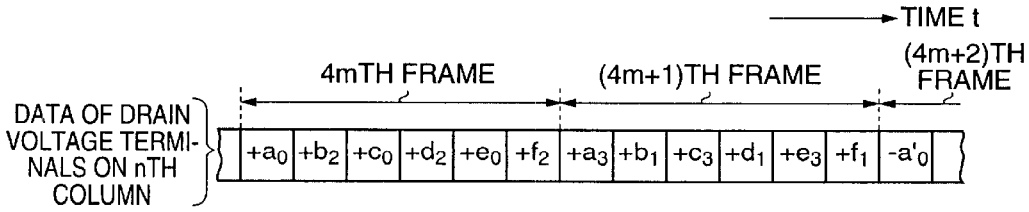

FIG. 13C will be described later.

The feasibility of the active matrix liquid crystal display device according to the first embodiment will be examined.

Matters that should be considered when adopting the present invention will be qualitatively described.

In a voltage write, the transistors Qo and Qe as the gate selection TFTs serve as input-side resistors of the gate bus lines LGko and LGke on each row. Accordingly, the sizes of the transistors Qo and Qe as the gate selection TFTs must be increased to such a degree that signal delay on the gate bus lines LGko and LGke becomes ignorable, so that the ON resistance is decreased sufficiently.

When the sizes of the transistors Qo and Qe as the gate selection TFTs are increased, the wiring constants of the parity gate lines LQo and LQe increase. Then, signals to be applied to the parity gate lines LQo and LQe are delayed, and the voltage cannot be sufficiently written in pixel electrodes on several rows.

To maintain the voltage, for example, in the odd-numbered frames, a high-potential signal for a voltage write on the odd-numbered row is applied to the drain electrode of the transistor Qe as the gate selection TFT on the even-numbered row. If a noise signal applied to the transistor Qe as the gate selection TFT causes a leakage effect of the charges written in the pixel electrodes on the even-numbered row, abnormal display occurs.

According to the present invention, the gate bus lines LGko and LGke are close to each other. Due to the parasitic capacitance between the adjacent gate bus lines LGko and LGke, gates on the rows that should be turned off are adversely affected by gates on the rows that should be turned on. If the leakage of charges in the held pixel electrodes is large, abnormal display occurs.

In order to quantitatively examine the above phenomena and to study the feasibility of the present invention, a circuit simulation was performed.

Figure 14:
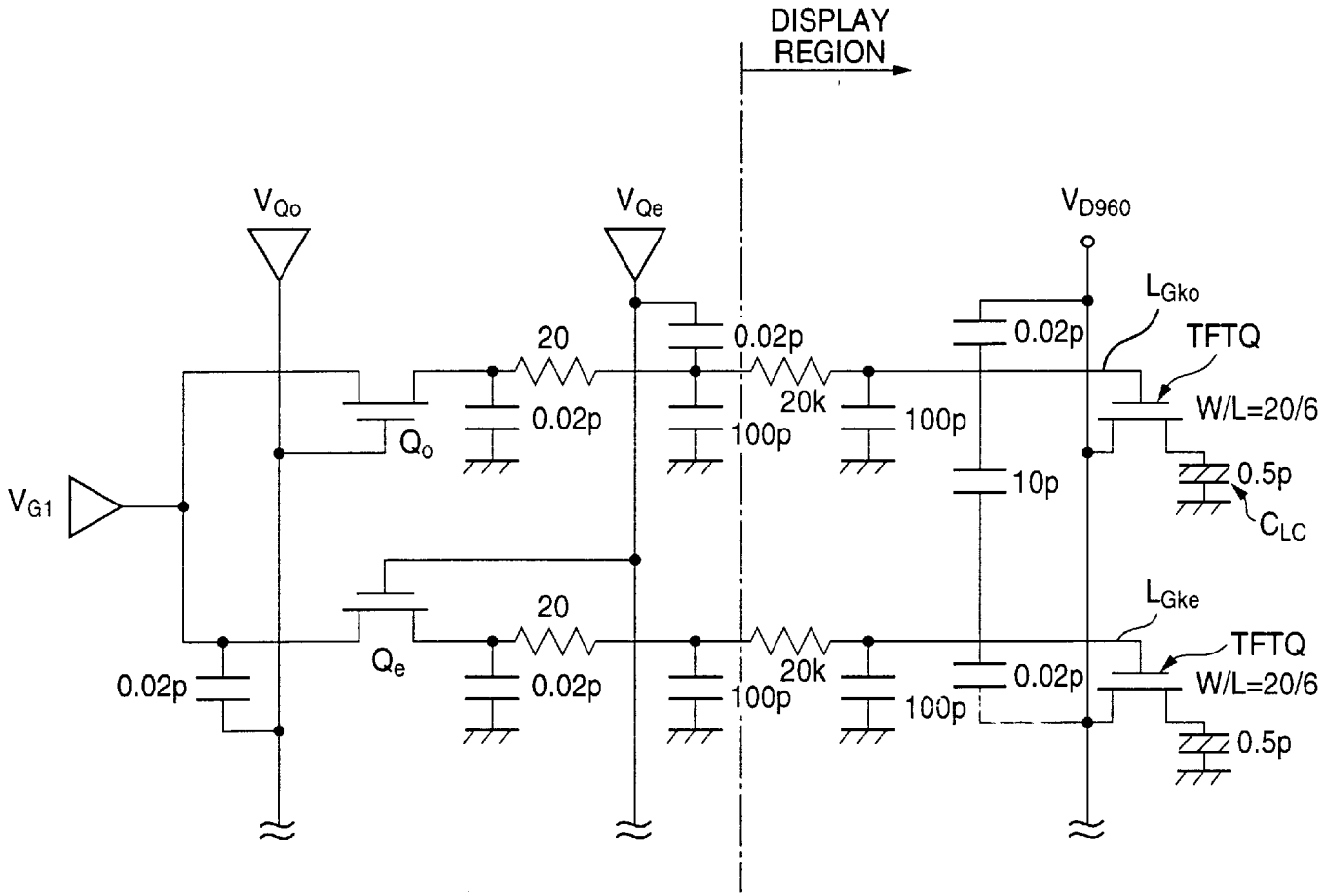
FIG. 14 is a circuit diagram for explaining the operation of the active matrix liquid crystal display device shown in FIG. 8.

FIG. 14 shows an equivalent circuit used for the circuit simulation. In the equivalent circuit shown in FIG. 14, the circuit constant and voltage pulses to be applied to the gate voltage terminal and drain voltage terminal of the transistor Q serving as the transistor TFT have values close to those obtained in an actual liquid crystal display panel having 2,400×600 pixels.

Figure 15:
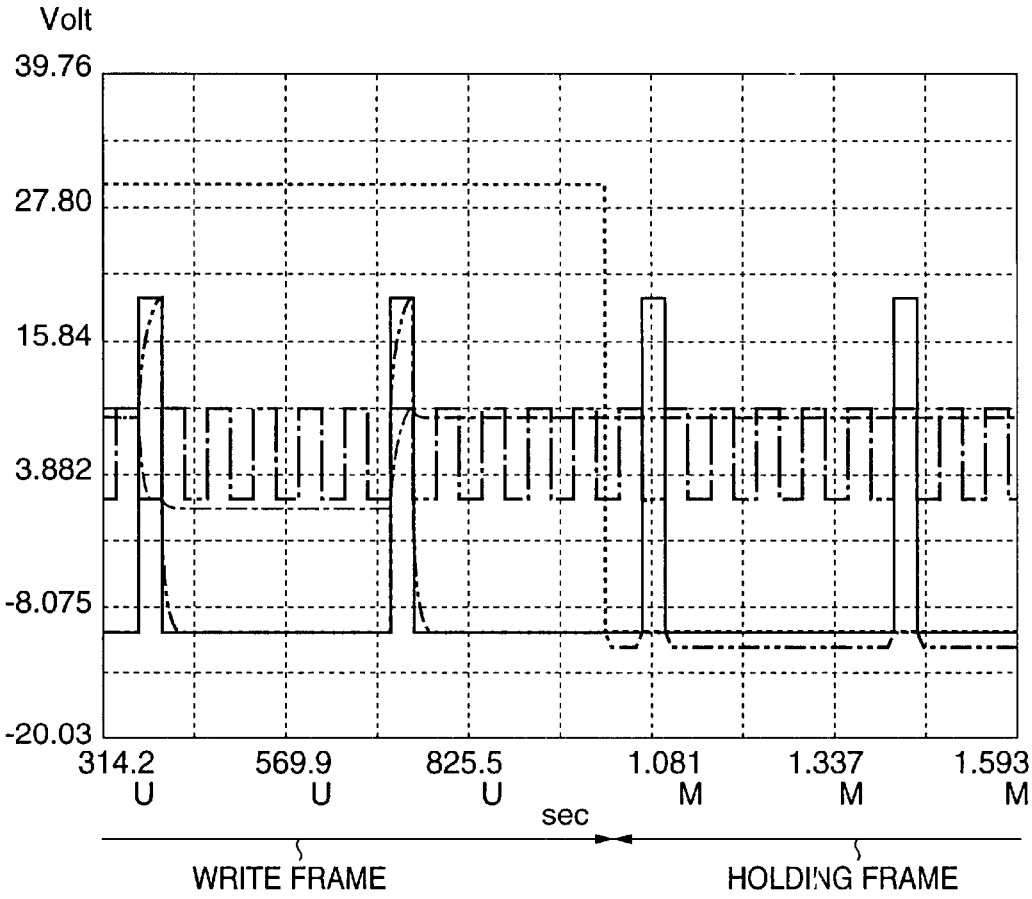
FIG. 15 is a graph for explaining the operation of the active matrix liquid crystal display device shown in FIG. 8.

The gap between the adjacent gate bus lines LGko and LGke is estimated to be 5 $\mu$m, which is the minimum value determined by the processing ability in electrode patterning. FIG. 15 shows the calculation results.

The write characteristics will be examined. A circuit simulation was performed for cases when the channel width between the transistors Qo and Qe as the gate selection TFTs was set to 1,000 $\mu$m, 2,000 $\mu$m, 3,000 $\mu$m, and 4,000 $\mu$m.

Figure 16A:
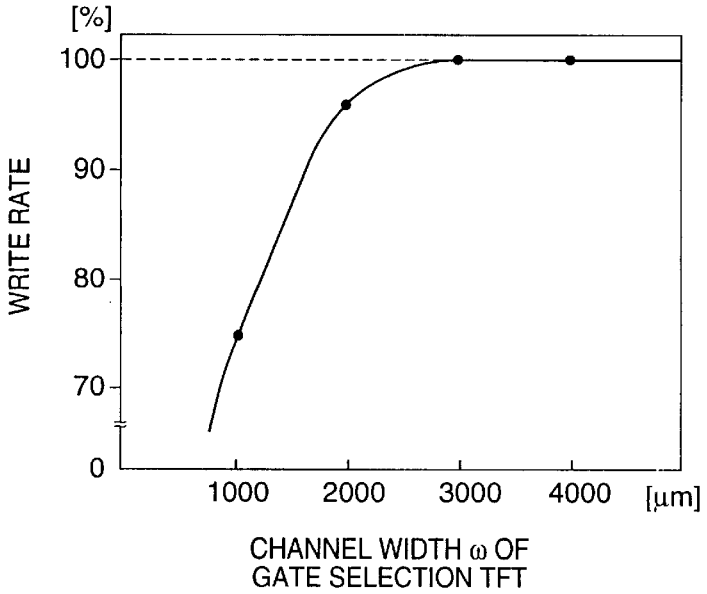
FIGS. 16A and 16B are graphs for explaining the operation of the active matrix liquid crystal display device shown in FIG. 8.
Figure 16B:
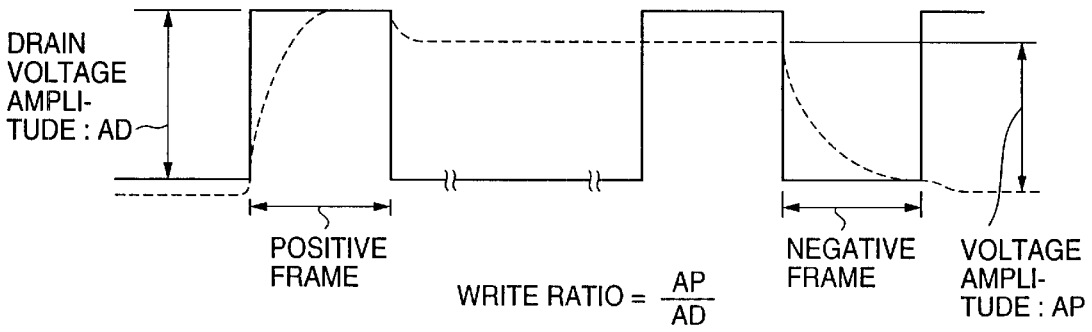

The channel length of the transistors Qo and Qe as the gate selection TFTs was set to 4 $\mu$m (constant). The write ratio defined in FIG. 16B was calculated for the respective cases. FIG. 16A shows the calculation results. It is obvious that when the channel length of the transistors Qo and Qe as the gate selection TFTs is equal to 3,000 $\mu$m or more, no problem occurs in a voltage write to the pixel electrodes.

Calculation of the wiring constant of the parity bus lines LPko and LPke for a case when the channel width is 3,000 $\mu$m yields about 40 $\mu$sec. With the wiring constant of this degree, if the transistors Qo and Qe as the gate selection TFTs are switched with a blanking period of about 1 msec, an insufficient write in several lines is not caused by pulse delay.

The holding characteristics will be examined.

Figure 17:
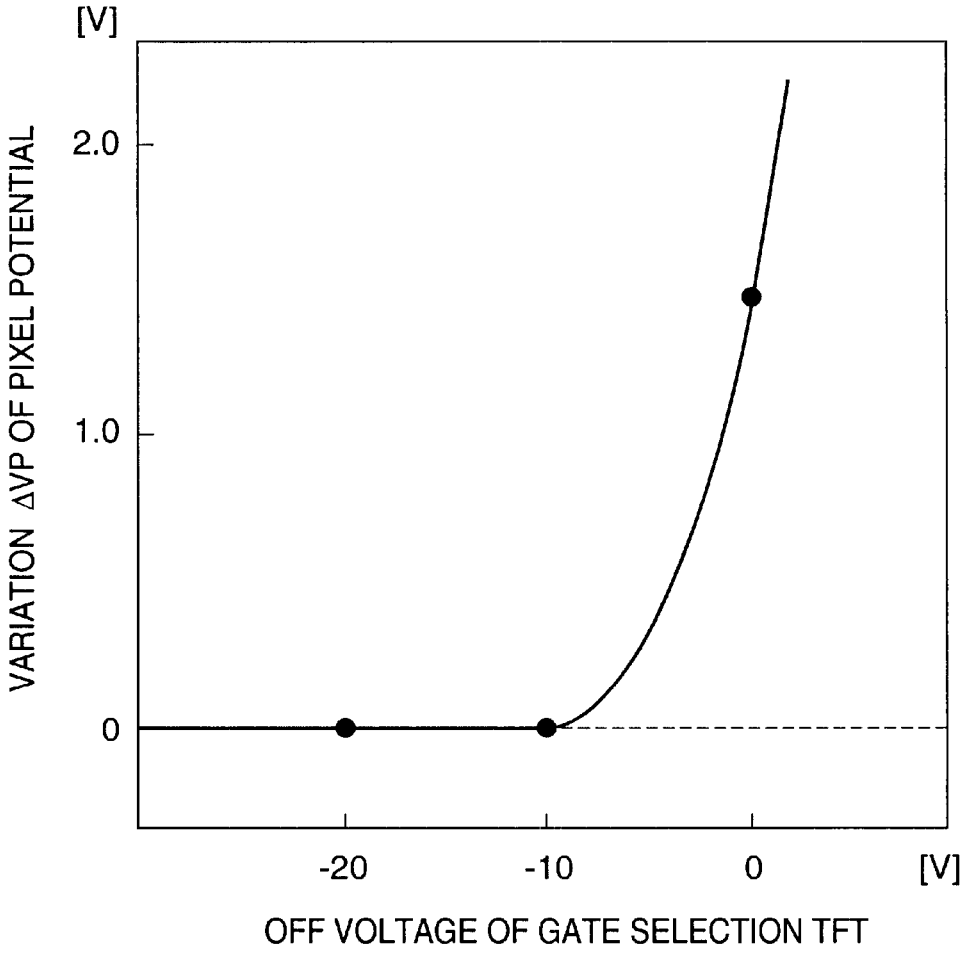
FIG. 17 is a graph for explaining the operation of the active matrix liquid crystal display device shown in FIG. 8.

Assume that the transistors Qo and Qe as the gate selection TFTs have a channel width of 3,000 $\mu$m and a channel length of 4 $\mu$m, and that the voltage obtained when the gate potentials of the transistors Qo and Qe as the gate selection TFTs are OFF is set to −20 V, −10 V, and 0 V. FIG. 17 shows the simulation result on the potential variation amount of a pixel at a half value in each of these cases, i.e., a pixel that should be held, in an off-frame, at a voltage with which the transmittance of the display device becomes 50% that of white display.

As is apparent from FIG. 17, the OFF voltage of the transistors Qo and Qe as the gate selection TFTs must be set to be lower than −10 V.

From the above calculation, if the size and voltage of the transistors Qo and Qe as the gate selection TFTs are set at values shown in Table 1, it enables the display device according to the first embodiment to operate in a preferable manner.

TABLE 1

| Design Parameter of Gate Selection TFT | Design Value |
|---|---|
| (Channel length/channel width) | 3000/4 or more |
| ON voltage | 30 V or more |
| OFF voltage | −10 V or less |

In this manner, according to the first embodiment, the number of drivers provided to the gate bus lines LGko and LGke is not increased, and the number of drivers for driving the expensive drain bus lines LD1 to LDm can be decreased. Therefore, an inexpensive display device can be manufactured.

According to the first embodiment, two pixel electrode driving transistors are connected to each of the drain bus lines LD1 to LDm, and the two parity bus lines LPko and LPke are prepared for each of the drain bus lines LD1 to LDm. The resultant display device is operated by interlaced driving that performs full-screen display with two frames. However, the present invention is not limited to this. For example, generally, n pixel electrode transistors may be connected to each of the drain bus lines LD1 to LDm, and n parity bus lines LPko and LPke may be prepared for each of the drain bus lines LD1 to LDm. The n parity bus lines LPko and LPke may be switched to the ON state in n frames to perform interlaced driving that performs full-screen display. In this case, the number of H drivers 302 can be set to 1/n.

Second Embodiment

Figure 18:
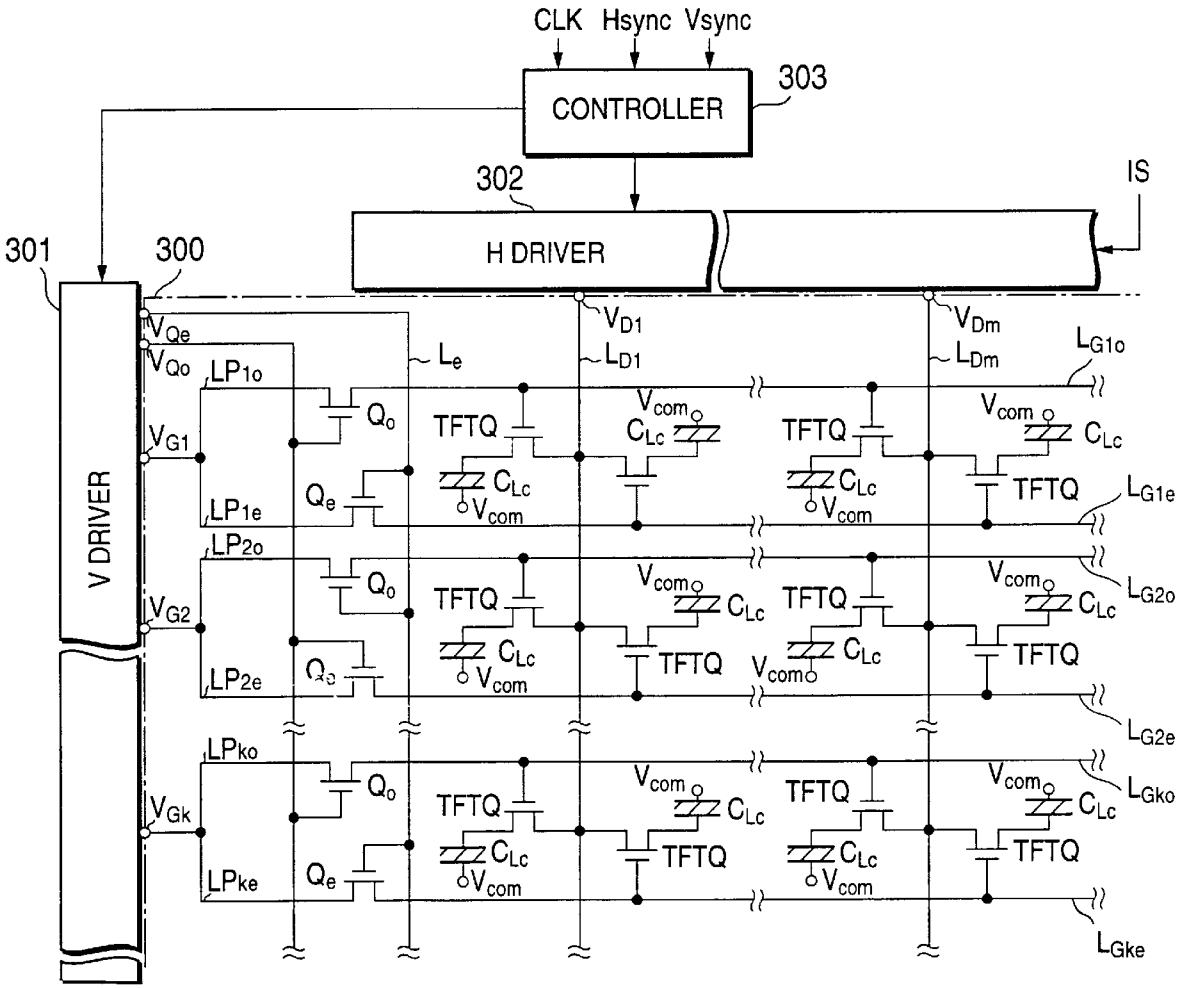
FIG. 18 is an equivalent circuit diagram showing an active matrix liquid crystal display device according to the second embodiment of the present invention.

FIG. 18 is an equivalent circuit diagram showing an active matrix liquid crystal display device according to the second embodiment of the present invention, and FIG. 19 and FIGS. 20A to 20D are views for explaining the operation of the active matrix liquid crystal display device shown in FIG. 18. In the drawings to be described later, portions common with those of FIG. 8 are denoted by the same reference numerals as in FIG. 8.

More specifically, in the first embodiment described above, on any row, the pixel electrodes on the odd-numbered columns are written with the signal on the parity line LPko, while the pixel electrodes on the even-numbered columns are written with the signal on the parity bus line LPke.

In contrast to this, according to the second embodiment, the pixel electrodes on the odd-numbered columns and the odd-numbered rows are written with the signal on the parity bus line LPko, while the pixel electrodes on the even-numbered columns and the odd-numbered rows are written with the signal on the parity bus line LPke. The pixel electrodes on the odd-numbered columns and the even-numbered rows are written with the signal on the parity bus line LPke, while the pixel electrodes on the even-numbered columns and the even-numbered rows are written with the signal on the parity bus line LPko.

Figure 19:
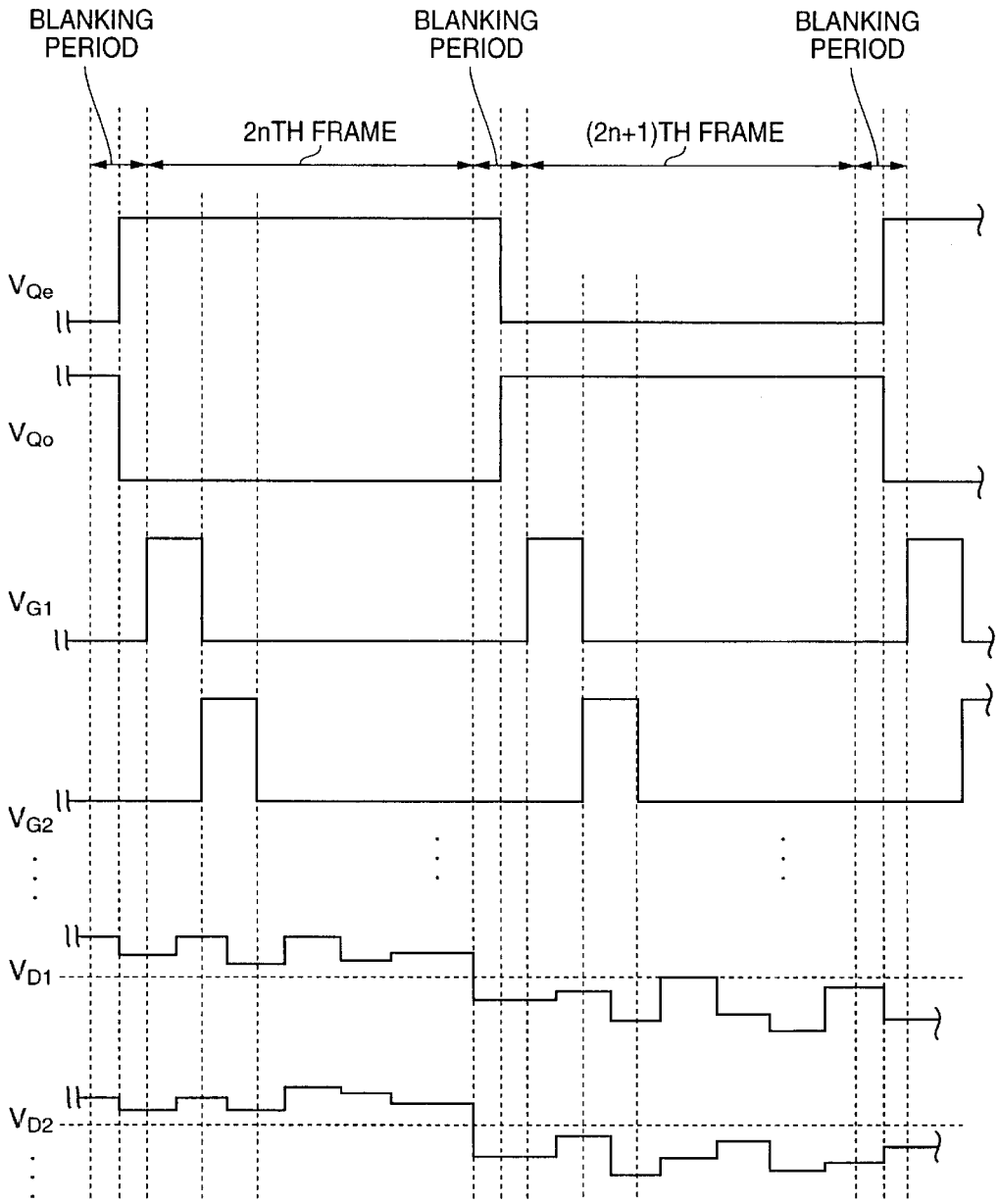
FIG. 19 is a timing chart for explaining the operation of the active matrix liquid crystal display device shown in FIG. 18.
Figure 20A:
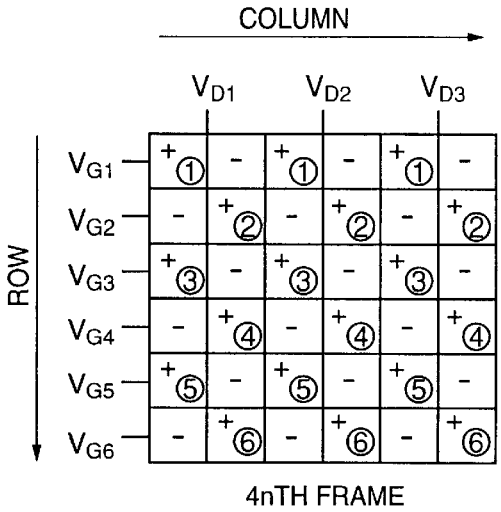
FIGS. 20A to 20D are views for explaining the operation of the active matrix liquid crystal display device shown in FIG. 18.
Figure 20B:
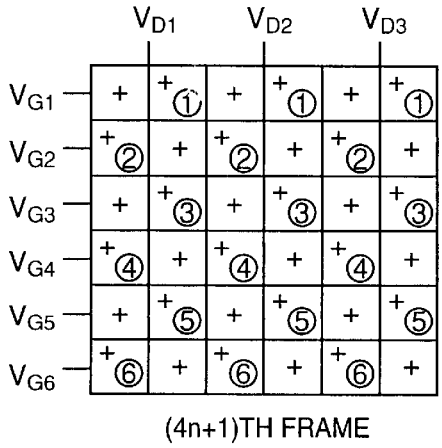
Figure 20C:
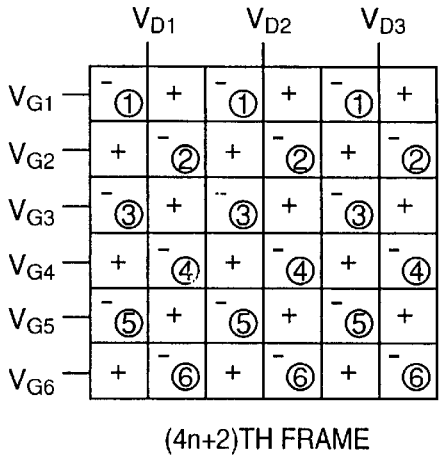
Figure 20D:
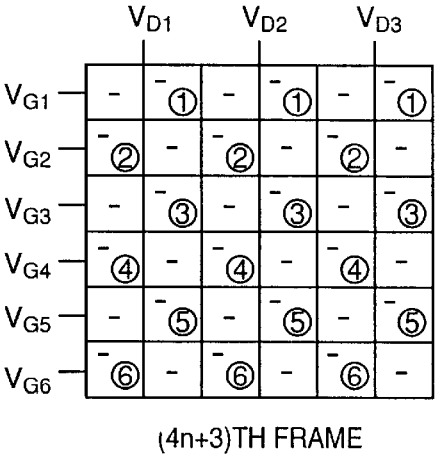

The operation of the active matrix liquid crystal display device having this arrangement will be described with reference to FIG. 19 and FIGS. 20A to 20D. FIG. 19 is a timing chart explaining the operation, and FIGS. 20A to 20D are views showing the voltage polarity and the voltage write order with which the voltage is written in the display pixels. In FIGS. 20A to 20D, circled numerals indicate the voltage write order to pixels in a certain frame.

As shown in FIGS. 20A to 20D, when following the voltage writes on the pixel electrodes on the time axis, the voltage is written in the pixels in the order of odd-numbered column→even-numbered column→odd-numbered column→even-numbered column→. . . The voltages applied to drain bus lines LD1 to LDm in one frame have the same polarity.

In the first embodiment, data on the even-numbered columns and on the odd-numbered columns are selected and switched in units of frames, as shown by the sequence of input data to the drain voltage terminal shown in FIG. 13C. In the second embodiment, data on the even-numbered columns and on the odd-numbered columns are selected and switched in units of rows.

This data selection is realized by setting an image signal, serving as the serial data to be input to an H driver 302, to have a period twice that of the prior art technique, and by shifting the reception timing in units of lines. The data reception timing signal is generated by a logic circuit in a controller 303 and input to the H driver 302.

In this manner, according to the second embodiment, in addition to the effect of the first embodiment, the voltages on the drain bus lines LD1 to LDm in the same frame have the same polarity. Thus, the power consumption can be reduced, and the pixel electrode write characteristics can be improved.

According to the second embodiment, two pixel electrode driving transistors are connected to each of the drain bus lines LD1 to LDm, and the two parity bus lines LPko and LPke are prepared for each of the drain bus lines LD1 to LDm. The resultant display device is operated by interlaced driving that performs full-screen display with two frames. However, the present invention is not limited to this. For example, generally, n pixel electrode transistors may be connected to each of the drain bus lines LD1 to LDm, and n parity bus lines LPko and LPke may be prepared for each of the drain bus lines LD1 to LDm. The n parity bus lines LPko and LPke are turned on in n frames to perform interlaced driving that performs full-screen display. In this case, the number of H drivers 302 can be set to 1/n.

Third Embodiment

The third embodiment has the same arrangement as those of FIGS. 8 and 18 of the first and second embodiments, but operates differently from the first and second embodiments, as will be described later.

In the third embodiment, n pixel electrode transistors are connected to each of drain bus lines LD1 to LDm, and n parity bus lines LPko and LPke are prepared for each of drain bus lines LD1 to LDm, in the same manner as in the first and second embodiments. This decreases the number of drain voltage terminals to 1/n that of the prior art technique.

More specifically, the n parity bus lines LPko and LPke are turned on in n frames to perform interlaced driving that performs full-screen display, in the same manner as in the first and second embodiments.

The third embodiment is different from the first and second embodiments in that one frame drawing time is set to 1/n times that of the conventional case. More specifically, one frame is drawn with a time of about 1/(50×n) to 1/(75×n) sec.

In this manner, according to the third embodiment, since the frame inversion period is multiplied by n, flicker reduction to the same level as in the prior art technique becomes possible. Therefore, when the number of drivers are decreased, the cost can be reduced, and flicker reduction can be achieved.

What is claimed is:

1. An active matrix liquid crystal display device comprising:

a pair of substrates that seal a liquid crystal;

thin film transistors arranged on one of said substrates to form a matrix of n rows×m columns;

display pixel electrodes connected to source electrodes of said thin film transistors in a one-to-one correspondence;

a value s being a number of image frames forming a full screen image, wherein the display device has m/s drain bus lines connected to drain electrodes of said matrix-type thin film transistors in an s-to-1 correspondence;

each s×n gate bus lines connected to gate electrodes of said thin film transistors on each row in one-to-one correspondence; and a value t being a time period to draw one of the image frames, wherein a controller for selecting n gate bus lines in each of s frames starts from an (s×t+1)th frame and ended with an (s×t+s)th frame, to perform one-screen display with said s frames.

2. An active matrix liquid crystal display device comprising:

a pair of substrates that seal a liquid crystal;

thin film transistors arranged on one of said substrates to form a matrix of n rows×m columns;

display pixel electrodes connected to source electrodes of said thin film transistors in one-to-one correspondence;

m/s (s and m are natural numbers that render m/s a natural number) drain bus lines connected to drain electrodes of said matrix-type thin film transistors in s-to-1 correspondence;

s×n gate bus lines connected to gate electrodes of said thin film transistors on each row in one-to-one correspondence; and a controller for selecting n gate bus lines in each of s frames starting from an (s×t(t is an arbitrary positive integer)+1)th frame and ended with an (s×t+s)th frame, to perform one-screen display with said s frames;

further comprising gate selection TFTs having drain electrodes, source electrodes, and gate electrodes, said drain electrodes in units of gate bus lines being connected to gate terminals, said source electrodes being connected to said gate bus lines, and said gate electrodes being connected to gate switch lines that are set at an ON voltage in one frame every s frames.

3. A device according to claim 2, wherein said gate selection TFTs are formed simultaneously with said thin film transistors connected to said display pixel electrodes in the same process.

4. A device according to claim 2, wherein said gate selection TFTs are formed of a semiconductor film made of amorphous silicon and having a ratio of channel length to channel width of not less than 3000/4.

5. A device according to claim 4, wherein said gate selection TFTs are turned on with a gate ON voltage of not less than 30 V, and turned off with a gate OFF voltage of not more than −10 V.

6. A device according to claim 2, wherein said gate selection TFTs are formed of a semiconductor film made of polysilicon.

7. A device according to claim 2, wherein said gate electrodes of said gate selection TFTs are switched within a blanking period.

8. A device according to claim 1, wherein one frame is drawn with a time of 1/(50×n) to 1/(75×n) sec.

* * * * *